United States Patent [19]

Doman et al.

[11] Patent Number: 4,682,729

[45] Date of Patent: Jul. 28, 1987

[54] SNOWMAKING MACHINE WITH COMPRESSED AIR DRIVEN REACTION FAN

[75] Inventors: D. Mark Doman; William R. Moss, both of Salt Lake City, Utah

[73] Assignee: The Dewey Electronics Corporation, Oakland, N.J.

[21] Appl. No.: 809,532

[22] Filed: Dec. 16, 1985

Related U.S. Application Data

[63] Continuation-in-part of Ser. No. 740,738, Jun. 3, 1985, abandoned.

[51] Int. Cl.[4] ..... F25C 3/04

[52] U.S. Cl. ..... 239/2.2; 239/14.2; 415/80; 261/35; 261/116

[58] Field of Search ..... 239/25, 14, 2.2, 14.2; 415/80; 261/35, 116; 62/74, 121

[56] References Cited

U.S. PATENT DOCUMENTS

| | | | |
|---|---|---|---|
| 3,104,803 | 9/1963 | Flatt | 415/80 X |
| 3,945,567 | 3/1976 | Rambach | 239/14 |
| 3,979,061 | 9/1976 | Kircher | 239/14 X |
| 4,493,457 | 1/1985 | Dilworth et al. | 239/14 X |

*Primary Examiner*—Andres Kashnikow
*Assistant Examiner*—Mary Beth O. Jones
*Attorney, Agent, or Firm*—Samuels, Gauthier Stevens & Kehoe

[57] ABSTRACT

A snowmaking apparatus comprising a tunnel-like housing a fan mounted within the housing to move large masses of air through the housing. Water nozzles and ice nucleating nozzles are disposed downstream of the fan. The fan is a compressed air reaction driven fan which provides a region of air lower in temperature within the housing than ambient to enhance the snowmaking process.

11 Claims, 3 Drawing Figures

SNOWMAKING MACHINE WITH COMPRESSED AIR DRIVEN REACTION FAN

CROSS REFERENCE TO RELATED APPLICATION

This application is a continuation-in-part of Ser. No. 740,738 filed June 3, 1985, now abandoned.

BACKGROUND OF THE INVENTION

In artificial snowmaking, there are basically two types of systems which are presently used. The first is the "airless" system and the other is known as the "air" or "air/water" system. The airless snowmaking systems are so named because they use very little compressed air in the snowmaking processes. These systems typically have a housing with a fan mounted upstream of an ice nucleator and water nozzles. The nucleator provides ice nuclei which mix with the water droplets discharged from the nozzles and the airstream created by the fan carries the ice nuclei-water droplet mixture into ambient where ultimately snow like crystals are formed. The initial patents embodying this concept are U.S. Pats. Nos. 3,567,117, Eustis; 3,703,991, Eustis and Howell; 3,733,029, Eustis and Howell; and 3,774,842, Howell. Additional patents in this field embodying the basic airless snowmaking concepts are U.S. Pat. Nos. 3,948,442, Dewey; 3,979,061, Kircher; 4,083,492, Dewey; 4,105,161, Kircher; 4,222,519, Kircher; and 4,223,836, Eager.

The air or air/water snowmaking systems employ compressed air and water both of which are discharged simultaneously from a nozzle. The compressed air provides the motive force for discharging the nucleated water particles, which are formed upon discharge from the nozzle, into the ambient until they form snowlike crystals. U.S. Pat. No. 2,676,471, Pierce, Jr. illustrates the air/water snowmaking techniques. Also of interest are U.S. Pats. Nos. 2,968,164, Hanson and 3,964,682, Tropeano.

The airless systems have been found to be highly efficient machines when compared with the air/water systems. The airless systems have the ability to produce more snow with a given amount of energy than the air/water systems, and they can eliminate the high cost of installing the relatively large central air compressor station required for the air/water systems. However, the costs of the airless systems are higher than air/water systems per se, where the air/water system is purchased for a ski area with an existing compressed air source. Even though most ski areas recognize the energy saving advantages of the airless systems, many ski areas which have central air compressors have been reluctant to install an airless system for a number of reasons. They do not want to install the large electrical distribution systems necessary for electrically powered airless systems or haul fuel for internal combustion engine powered airless systems. They do not have the terrain on which the large airless system snowmaking machines can be moved or the equipment to move them with or they do not have the cold ambient temperatures that make airless sytems most economical. Lastly, they do not want to abandon use of the compressed air station.

A third type of system has been proposed which is broadly described in U.S. Pat. No. 3,945,567, Rambach. This system purports to combine features of both the airless and air/water systems. It provides for the separate formation of ice nuclei and water droplets. An air motor powered by compressed air drives a fan, dispensing with the need for electrical power or power from an internal combustion engine. This system allows ski areas which are already equipped for the air/water systems to substitute this system for the conventional air/water systems. As a practical matter the systems using air motors to drive a fan have operational difficulties. The expansion and shaft work of the air in the motor results in the cooling of the air well below the freezing point of water. Since compressed air usually contains water vapor, formation and deposition of ice takes place which then renders the air-motor inoperative.

The present invention is directed to a system for snow making which system uses the nucleator, water droplet, fan concept of the airless systems and is powered by compressed air. The system avoids the difficulties of icing or freeze up of the fan by the use of a reaction fan. The reaction fan discharges its compressed air from the tips of the blades (external air jet reaction) in free space within the housing downstream of the fan. The system enhances the efficiency of snowmaking particularly at higher temperatures (26°–32° F.), by creating a flow of supercooled (i.e. subfreezing) air, in the region of the ice nuclei-water droplet discharge.

The method of my invention includes creating in separate zones ice nuclei and water droplets, generating a supercooled airstream by the expansion of compressed air and flowing the supercooled airstream into the region wherein the ice nuclei and the water droplets commingle to form an ice nuclei-waterdroplet mixture. The mixture is discharged to ambient whereby snowlike crystals are formed.

The apparatus of the invention broadly comprises a nucleator to provide for the generation of ice nuclei which is spaced apart from water nozzles for the creation of water droplets. Means to create an airstream by the discharge of compressed air is provided with results in a supercooled airstream which flows and contacts the ice nuclei-water droplet.

More particularly in the present invention a reaction fan driven by compressed air is used. The expansion of the compressed air discharged from the reaction jets takes place in essentially free space within the housing the result being that the ice particles formed upon discharge of the compressed air are carried away in the airstream without difficulty. This allows use of an air driven fan in snowmaking which avoids the problems of freeze up and further provides for a supercooled airstream within the housing and in the region if discharge of the water droplets and ice nuclei for enhanced snowmaking efficiency. Additionally a source of ice nuclei are provided in addition to those created by the nucleator.

It is well understood that in snowmaking it is necessary to vary the flow of the water depending primarily upon the temperature at which the snow is made. This is commonly achieved by putting valves on at least some of the nozzles which produce the water droplets. If a nozzle which is facing upwardly, (such as a nozzle on the lower half of a manifold ring) is shut off with a valve behind the nozzle, typically some water will remain in the nozzle which will freeze and disable the nozzle from further use.

The airless systems use electric heaters to obviate this problem. Our invention further provides for a valve system which is designed to avoid the problems of freeze up without relying on thermal energy from an independent source to prevent the freeze up.

DESCRIPTION OF THE PREFERRED EMBODIMENT(S)

Referring to FIG: 1 a snowmaking machine is shown generally at 10 and comprises a housing 12 secured on a stand 14.

Figure 3:
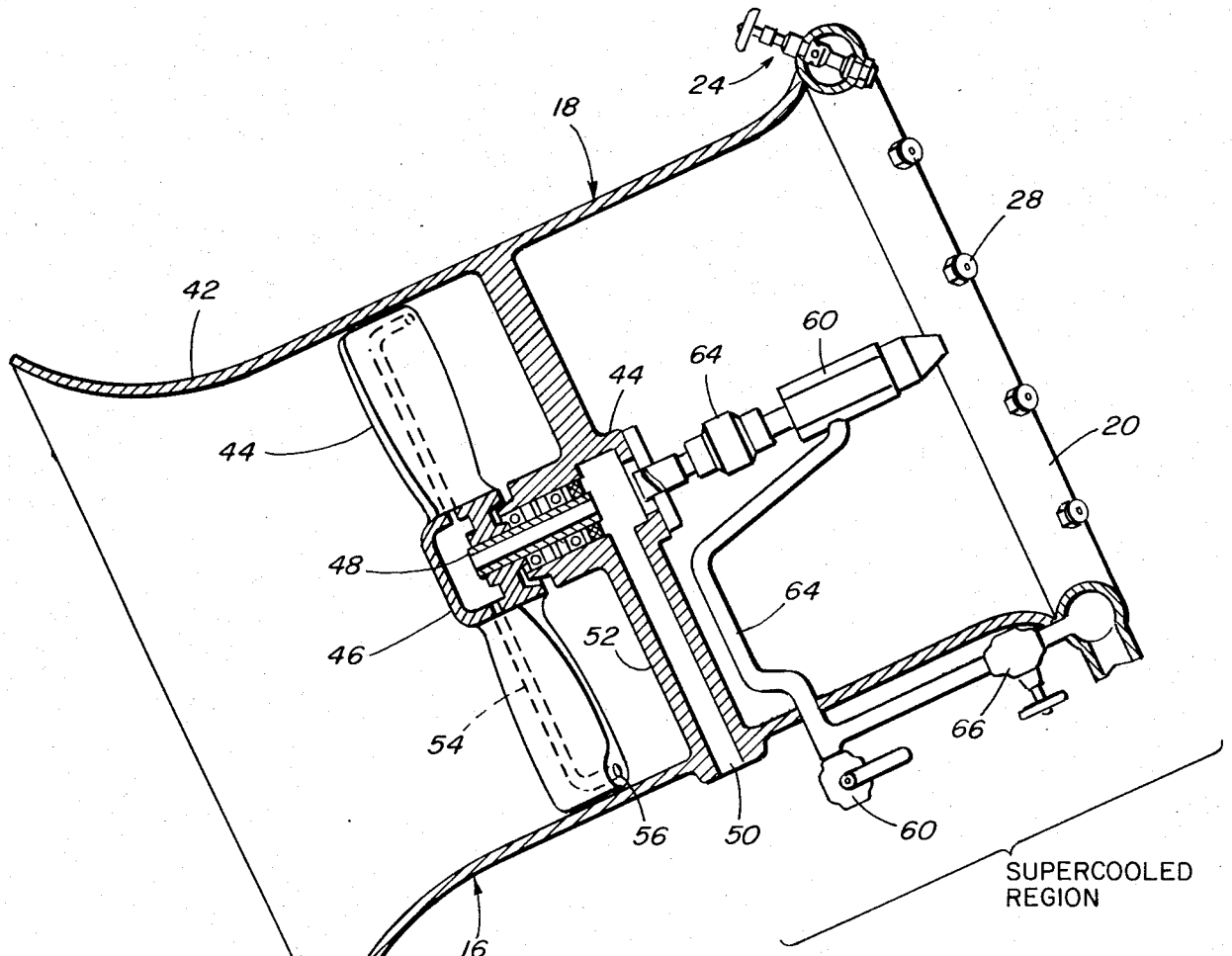
FIG. 3 is a side sectional view of the embodiment of the machine shown in FIG. 1.

Referring to FIG. 3 the housing 12 is formed by joining a fan assembly 16 to a duct 18. An annular water supply manifold 20 surrounds and is joined to the housing at its downstream end. A plurality of valved nozzles 24 are mounted in the upper half of the manifold 20. The manifold is connected to a suitable source of water (not shown).

Nozzles 28 such as Spraying Systems nozzles type ¾ FF-9 or Delavan WS-10 are secured to upper and lower halves of the manifold 20 respectively. More particularly the nozzles in the upper half of the manifold are secured to valves 24, as will be described, and the nozzles in the lower half of the manifold are secured directly thereto. As is understood in snowmaking different nozzle sizes are typically available for the formation of water droplets and are used either alone or in combination depending upon the ambient conditions at the time of making of the snow.

Figure 1:
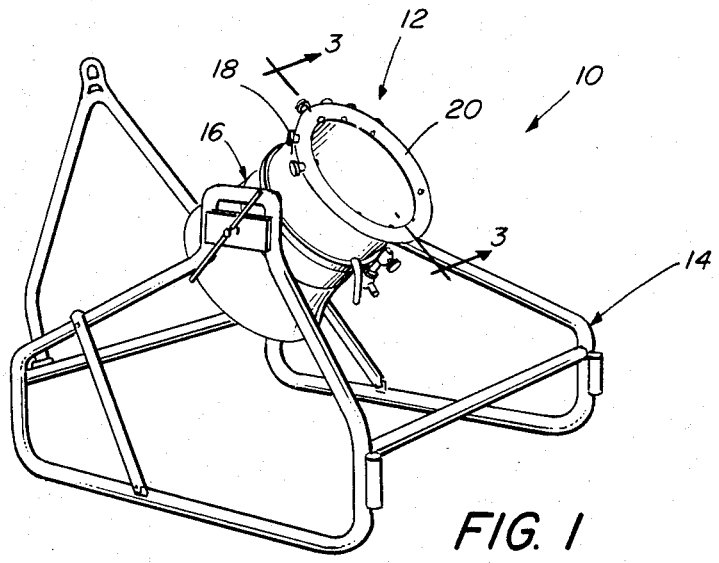
FIG. 1 is a prospective view of the snowmaking machine embodying the invention.
Figure 2:
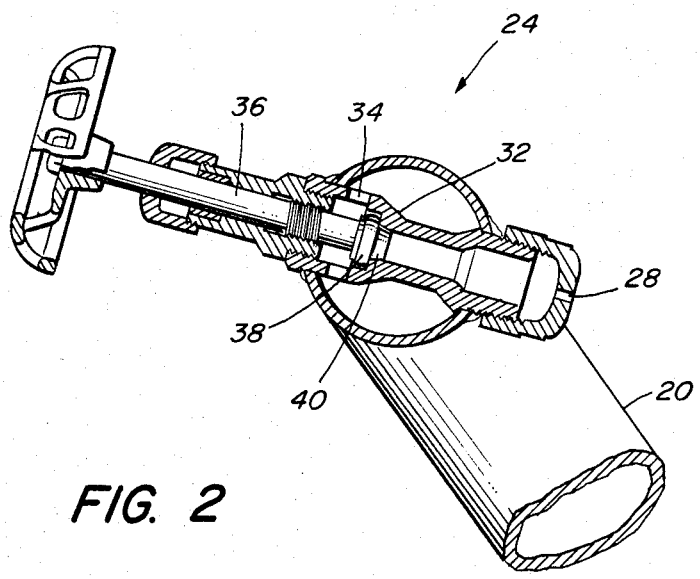
FIG. 2 is a sectional view of a valve used for the control of water flow for the water droplets.

Referring to FIG. 2 the valve 24 is designed to ensure that during operation water is flowing across the valve seat to inhibit freezing. The valve has a body 32 with inlet ports 34 and includes a valve stem 36 that extends through one side of the manifold 20 and terminates in a handle. The valve body 32 has a narrow waist to minimize water displacement and to ensure maximum flow of water around of the valve body to avoid freezing. A closure member 38 is at the inner end of the stem and cooperates with a valve seat 40 to admit measured amounts of water to exit the nozzle 28 that is aimed from the manifold into the airstream. Its water inlet ports 34 are upstream from the valve seat 40 which in turn is upstream from the nozzle 28. This permits changing of nozzles on individual valves even though the rest of the system is under operating pressure. Also it allows water to drain from the nozzles when the valve is off.

Referring to FIG. 3 the fan assembly 16, such as a Coppus RF-20, generates the air flow through the housing. Although described with reference to a specific reaction fan any reaction fan is suitable for purpose of the invention. The assembly 16 includes an entrance bell 42 which is bolted to the cylindrical duct 18 forming a smooth inner housing surface. Radial blades 44 extend from a hollow hub 46. The hub 46 is mounted on a quill shaft 48 which in turn is journaled in bearings with suitable seal rings as well as thrust and radial bearings and retainers. The quill shaft 48 connects to a stationary hub 49 and to a main compressed air inlet 50 formed in a crossbrace 52. The fan blades 44 have individual conduits 54 that connect to the hollow hub at one end and terminate in outlet jets 56.

A nucleator 60 such as a Delavan Air Atomozing nozzle #30616-29 is joined to the hub 49. The nucleator is a pneumatic atomizer which forms ice nuclei due to the adiabatic expansion of compressed air. The nucleator 60 needs both compressed air and water to function. The air comes from the stationary air hub 49 and is fed through a check valve 62, which is to insure that no water enters the fan should there be no air pressure to counteract it. Water enters the nucleator 60 through a tube 64 which is positioned in line with the inlet air spoke 52. The flow of water through the tube 64 into the nucleator 60 is controlled by a valve 66. A drain valve 68 is used when the nucleator 60 is not operating.

The following decription is a summary of results based on tests conducted with the snowmaking system substantially as described herein.

In the operation of the invention compressed air preferrably between 80 and 100 psi (which is consistent with the requirements for the Coppus RF-20 fan as well as existing air/water snowmaking equipment) was introduced in to the air passageway 50. Typically the air is introduced at a temperature of between 40° to 60° F. The air flows through the inlet 50. From there it enters the stationery hub 49 and is sealed in by a slip ring. The only paths available are either to the nucleator 60 or the quill shaft 48. The quill shaft 48 serves to support the fan 44 and it transmits compressed air from the stationary hub 49 to the fan. The air travels into the fan blades through passages 54. The passages make 90 degree bends. The compressed air is discharged from the orifices 56 at the trailing edges of the fan blades. The fan is spun by a simple transfer of momentum between the exiting compressed air and the fan blades.

The air flow through the fan is between 180 to 220 cfm. Approximately 11,000 cfm of low pressure moving ambient air is produced by rotation of the fan blade drawing the ambient air into and through the housing.

The discharge of the compressed air results in a supercooling of the airstream flowing through the housing and generally in the zone as shown in FIG. 3. The degree reduction in temperature in the zone is approximately −2° F. regardless of ambient temperature.

Snow was successfully made using Delevan WS-10 nozzles at an ambient temperatures of 35° F. and lower with a total flow rate through the nozzles of 10 gpm. Compressed air flow was 220 cfm through the fan and compressed air flow through the nucleator was between 20 to 30 cfm. The water flow through the nucleator was between 2 to 3 gpm and the temperature of the water flowing to the nozzles and nucleator was between 45° to 50° F. Water pressure was 110 psi and air pressure was 95 psi.

Expanding air exiting the fan blades imparted a swirling motion to the air along the inner wall of the housing. The expansion of the compressed air cooled the mass flowing through the housing, at least until it mixed with the ice nuclei and water droplets.

With ambient temperatures between 30° to 35° F. and within the ranges described above snow was successfully made.

Generally the test to determine if snow is successfully made is to allow the fall out from the wake stream to contact a cloth or plastic film. Visual observation establishes whether or not crystals (snow) or water fall on the film.

In general the air jets should be directed in a path or extension of a path that defines a chord near the circumference of the circle which the fan rotates; or tangent to such a circle. In actual application the jets are directed from the blade tips with flow components opposite to the direction of the rotation of the fan and axially in the direction of the airstream generated by the fan.

Having described our invention what we now claim is:

1. A method for making snow which includes:
creating ice nuclei;
forming water droplets;
forming an airstream and flowing said airstream through a housing;
supercooling said airstream approximately 2° F. lower than ambient by the expansion of compressed air;
flowing the supercooled airstream into the water droplets and ice nuclei;
commingling in the supercooled airstream, the ice ncluei and the water droplets to form an ice nuclei-water droplet mixture;
discharing the mixture to ambient to form snow-like crystals.

2. The method of claim 1 which includes:
discharging the compressed air from a reaction fan.

3. The method of claim 1 which includes:
flowing the supercooled airstream through a housing.

4. The method of claim 3 which includes:
discharging from a reaction fan a plurality of jets of compressed air.

5. The method of claim 4 which includes:
forming additional ice nuclei when the compressed air jets are discharged from the reaction fan.

6. The method of claim 1 which includes:
forming the ice nuclei in a first zone;
forming the water droplets in a second separate zone.

7. The method of claim 6 which includes:
forming the ice nuclei and water droplets downstream of the formation of the supercooled airsteam.

8. A snowmaking system which comprises:
a housing;
means to create ice nuclei;
means to form water droplets;
a fan to form an airstream to flow through the housing spaced apart from the means to create the ice nuclei and the means to form the water droplets;
means to discharge compressed air to supercool the airstream approximately 2° F. lower than ambient; and
means to flow the supercooled airstream into the ice nuclei and water droplets whereby the ice nuclei and water droplets are mixed and discharged into ambient to form snowlike crystals.

9. The system of claim 8 wherein:
the means to create the ice nuclei and the means to form the water droplets are spaced apart from one another.

10. The system of claim 8 wherein the housing is a tunnel-like housing.

11. The system of claim 8 wherein the fan is a reaction fan, and the supercooling is effected by the compressed air discharged from said reaction fan.

* * * * *